US011541664B2

(12) United States Patent
Hsieh

(10) Patent No.: US 11,541,664 B2
(45) Date of Patent: Jan. 3, 2023

(54) INK-SACK-REPLACEABLE INK CARTRIDGE

(71) Applicant: TAIWAN NANOTECHNOLOGY CORPORATION, Taichung (TW)

(72) Inventor: Cheng-Yang Hsieh, Taichung (TW)

(73) Assignee: TAIWAN NANOTECHNOLOGY CORPORATION, Taichung (TW)

( * ) Notice: Subject to any disclaimer, the term of this patent is extended or adjusted under 35 U.S.C. 154(b) by 0 days.

(21) Appl. No.: 17/471,114

(22) Filed: Sep. 9, 2021

(65) Prior Publication Data

US 2022/0097394 A1 Mar. 31, 2022

(30) Foreign Application Priority Data

Sep. 29, 2020 (TW) ..... 109133926

(51) Int. Cl.
*B41J 2/175* (2006.01)

(52) U.S. Cl.
CPC ..... *B41J 2/17513* (2013.01); *B41J 2/17506* (2013.01); *B41J 2002/17516* (2013.01)

(58) Field of Classification Search
CPC ..... B41J 2/17506; B41J 2/17513; B41J 2/17516; B41J 2/1752; B41J 2/17526; B41J 2002/17516
See application file for complete search history.

(56) References Cited

U.S. PATENT DOCUMENTS 5,666,146 A * 9/1997 Mochizuki ..... B41J 2/17513 347/86
6,053,606 A * 4/2000 Yamaguchi ..... B41J 2/17559 347/86

* cited by examiner

*Primary Examiner* — Anh T Vo
(74) *Attorney, Agent, or Firm* — Leong C. Lei

(57) ABSTRACT

An ink-sack-replaceable ink cartridge includes a cartridge body, which includes a bottom wall, two lateral walls extending upward from two sides of the bottom wall, and two end walls extending upward from two ends of the bottom wall and connected to the lateral walls. The bottom wall, the lateral walls, and the end walls jointly define a receiving space. The bottom wall is formed with a through hole. Each of the lateral walls includes a cartridge-body slide coupling section. A cartridge cover includes a top wall and two side walls extending downward from two sides of the top wall. Each of the side walls includes a cartridge-cover slide coupling section. The cartridge-cover slide coupling sections are slidably connectable with the cartridge-body slide coupling sections, so that the cartridge cover is combinable with and separable from the cartridge body through slidable connection for closing or opening the receiving space.

13 Claims, 11 Drawing Sheets

INK-SACK-REPLACEABLE INK CARTRIDGE

TECHNICAL FIELD OF THE INVENTION

The present invention relates to an ink cartridge, and more particularly to a structure of an ink cartridge of which an ink sack is replaceable.

DESCRIPTION OF THE PRIOR ART

As shown in FIGS. 1-3, a known ink cartridge 1 generally comprises a cartridge body 2, an ink sack 3 disposed inside the cartridge body 2, a pressing board 4 adhered to the ink sack 3, and a cartridge cover 5 mounted on the cartridge body 2.

Lateral walls of the cartridge body 2 are formed, in inside surfaces thereof, with a plurality of snap notches 6, and outer edges of the cartridge cover 5 are formed with a plurality of snap blocks 7 each in the form of a hook. The snap blocks 7 of the cartridge cover 5 are snap fit into the snap notches 6 of the cartridge body 2 (as shown in FIG. 3) to combine and couple the cartridge cover 5 and the cartridge body 2 to each other. Such a coupling arrangement makes it hard to separate the snap blocks 7 from the snap notches 6 once they are snap fit to each other. This means it is not possible to intactly separate the cartridge cover 5 from the cartridge body 2. Consequently, when the ink contained in the ink sack 3 is used up, a user is not allowed to replace the ink sack 3 alone, and replacement is allowed only for the entirety (including the ink sack, the cartridge body, the cartridge cover, and the pressing board). However, the cartridge body 2 and the cartridge cover 5 still work wall as they are not damaged. Thus, such an arrangement that does not allow for replacement of the ink sack 3 is in fact causing issues of waste of resources and increase of expenditure.

Further, the cartridge body 2 is provided with a through hole 8 and the pressing board 4 includes a pressing portion 9, such that when the ink contained in the ink sack 3 is gradually running out and the ink sack 3 becomes flattening, the pressing portion 9 displaces into the through hole 8 to trigger a sensing element installed in a printer so as to detect a remaining amount of the ink for displaying to and notifying a user. However, before the ink sack 3 is still in a saturated condition, the pressing portion 9 that is provided on the pressing board 4 is not yet penetrating into the through hole 8 and the position of the pressing portion 9 is thus not constrained, so that any swaying occurs before use, the pressing portion 9 may get deviated in position, making the pressing portion 9 not in alignment, in position, with the through hole 8. Consequently, when the ink sack 3 gets flattening, the pressing portion 9 may not correctly penetrate into the through hole 8, leading to incorrect data displaying for the sensor of the printer and not providing the user with correct information in time for purchasing a new ink cartridge to replace the used one, eventually resulting in undesired delay of work or operations.

Further, it needs to form projections in the cartridge body 2 to serve as the two constraint walls 91, so that lateral movements of the connector 92 is constrained when the connector 92 of the ink sack 3 is inserted between the two constraint walls 91. However, such constraining only works for movement in the lateral direction, but there is still movement allowed in a longitudinal direction, and this would result in poor connection between the connector 92 and an ink feeding tube of the printer. Although some manufacturers suggest an arrangement of constraining trough between the two constraint walls 91 to receive a retaining ring 93 of the connector 92 to insert therein in order to constrain the longitudinal movement of the connector 92. In reality, there are a great number of manufacturers that make ink sacks 3, and they do not provide the retaining ring 93 on the connector 92 at the same location. Thus, it is quite common that the retaining ring 93 may not be correctly inserted into the constraining trough.

SUMMARY OF THE INVENTION

In view of the above, to overcome the problems of the prior art techniques, in which the known ink cartridge suffers non-replaceability of the ink sack, and thus waste of resources, increase of expenditure, incorrect detection of ink amount by a printer, poor positioning of the connector of the ink sack, and size errors, the present invention provides an ink-sack-replaceable ink cartridge, which comprises: a cartridge body, wherein the cartridge body comprises a bottom wall, two lateral walls extending upward in a vertical direction from two lateral sides of the bottom wall, and two end walls extending upward in a vertical direction from two ends of the bottom wall, and the end walls are connected to the lateral walls, so that the bottom wall, the lateral walls, and the end walls jointly surround and define a receiving space, the bottom wall comprising a through hole penetrating through top and bottom thereof, each of the lateral walls is provided with a cartridge-body slide coupling section; and a cartridge cover, wherein the cartridge cover comprises a top wall and two side walls extending downward from two sides of the top wall, each of the side walls being provided with a cartridge-cover slide coupling section. Each of the cartridge-cover slide coupling sections is slidably connectable with each of the cartridge-body slide coupling sections, so as to allow the cartridge cover to combine with and separate from the cartridge body through slidable connection for closing or opening the receiving space, in order to easily replace the ink sack received in the receiving space to thereby achieve the effectiveness of effective use of resources and reducing the spent amount of money.

The present invention also provides an ink-sack-replaceable ink cartridge, which comprises a cartridge body, wherein the cartridge body comprises a bottom wall, two lateral walls extending upward in a vertical direction from two lateral sides of the bottom wall, and two end walls extending upward in a vertical direction from two ends of the bottom wall, and the end walls are connected to the lateral walls, so that the bottom wall, the lateral walls, and the end walls jointly surround and define a receiving space, the bottom wall comprising a through hole penetrating through top and bottom thereof, the bottom wall comprising two constraint walls located in the receiving space, two constraining troughs being arranged between the two constraint walls, each of the lateral walls being provided with a cartridge-body slide coupling section, two positioning protrusions being formed on an inside surface of one of the lateral walls and extending in a vertical direction, the two positioning protrusions being respectively located at two ends of the through hole, the two positioning protrusions each having a guide surface, the guide surfaces being smoothly connected with inside surfaces of the through hole; an ink sack, wherein the ink sack is received in the receiving space of the cartridge body, and the ink sack comprises a sack body and a connector connected to an end of the sack body, the connector having an outer circumferential surface on which a limiting block is formed, the limiting block being insertable into one of the constraining troughs of the cartridge body; a pressing board, wherein the pressing board is bonded to the ink sack, a sensing section extending downward from one side of the pressing board, the sensing section being positionable between the two positioning protrusions of the cartridge body and alignable with the through hole; and a cartridge cover, wherein the cartridge cover comprises a top wall and two side walls extending downward from two sides of the top wall, each of the side walls being provided with a cartridge-cover slide coupling section, each of the cartridge-cover slide coupling sections being slidably connectable with each of the cartridge-body slide coupling sections, so as to allow the cartridge cover to combine with and separate from the cartridge body through slidable connection for closing or opening the receiving space, in order to achieve the effectiveness of easy replacement of ink sacks, effective use of resources, reducing the spent amount of money, more accurate detection of the amount of ink, making the ink sack constrained in position, and being adapted to various ink sacks supplied from different manufacturers.

DETAILED DESCRIPTION OF THE PREFERRED EMBODIMENT

Figure 1:
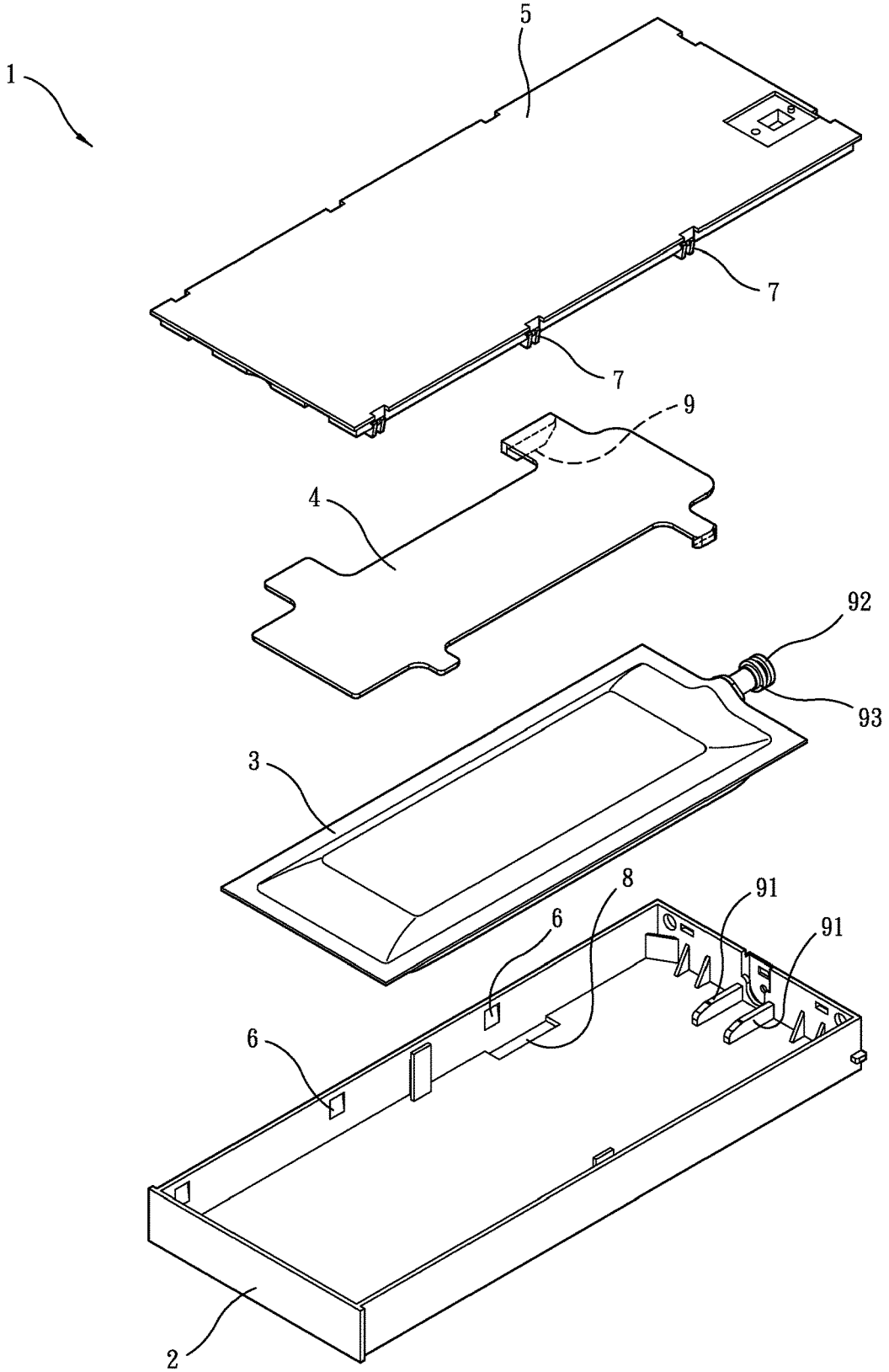
PRIOR ART FIG. 1
FIG. 1 is an exploded view showing a known ink cartridge.
Figure 2:
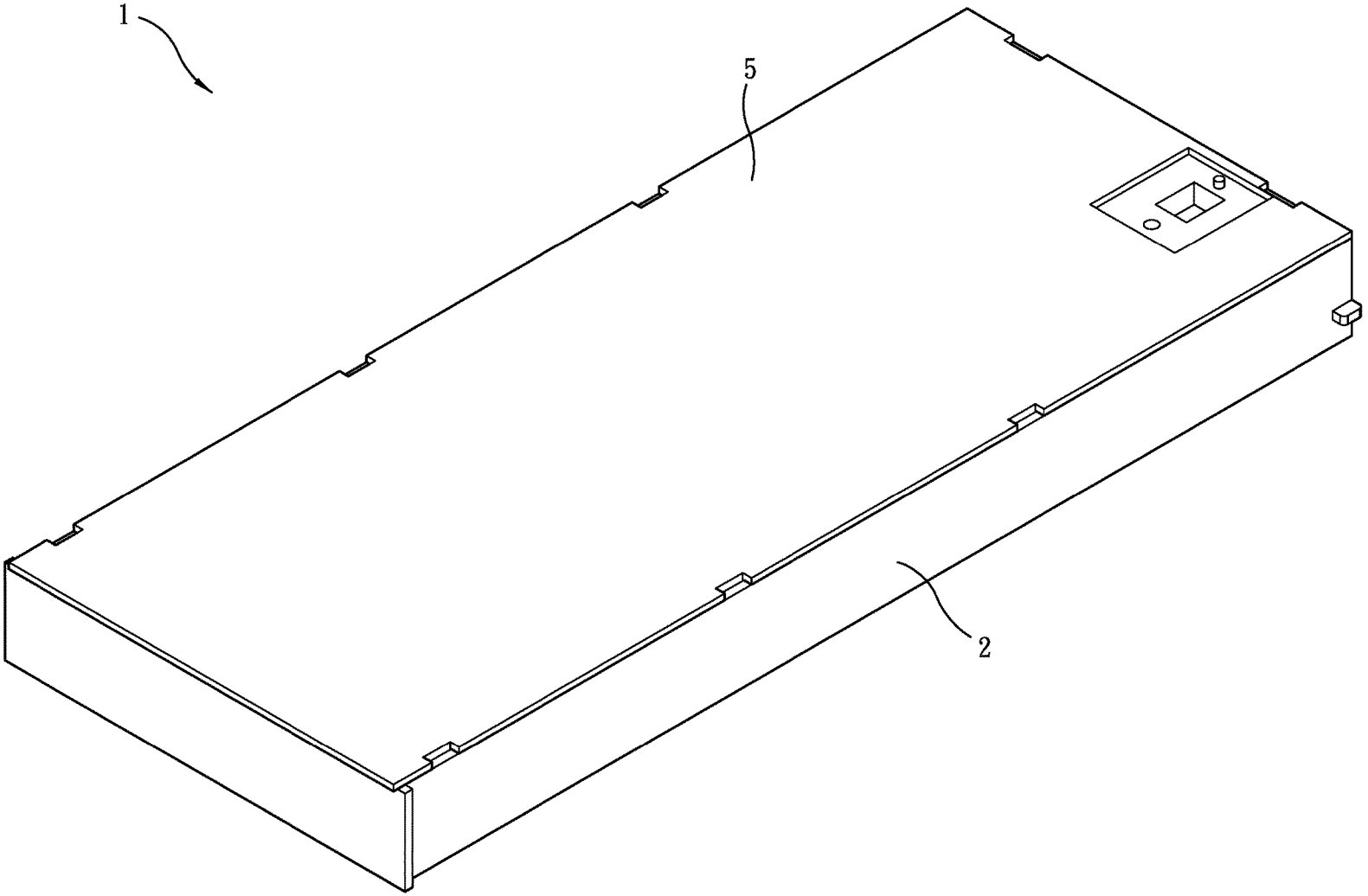
PRIOR ART FIG. 2
FIG. 2 is a perspective view showing the known ink cartridge of FIG. 1 in an assembled form.
Figure 3:
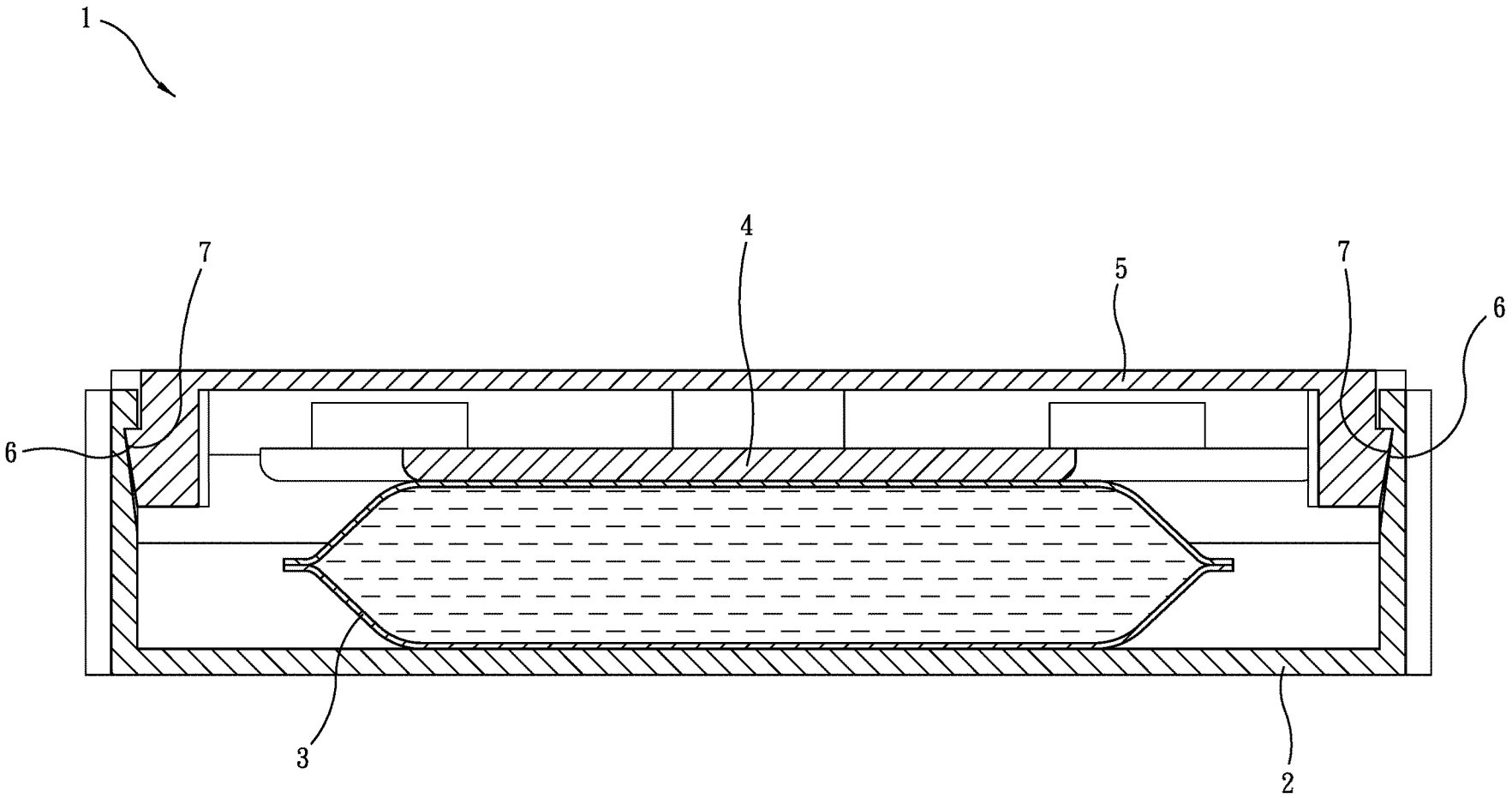
PRIOR ART FIG. 3
FIG. 3 is a cross-sectional view showing the known ink cartridge of FIG. 1 in an assembled form.
Figure 4:
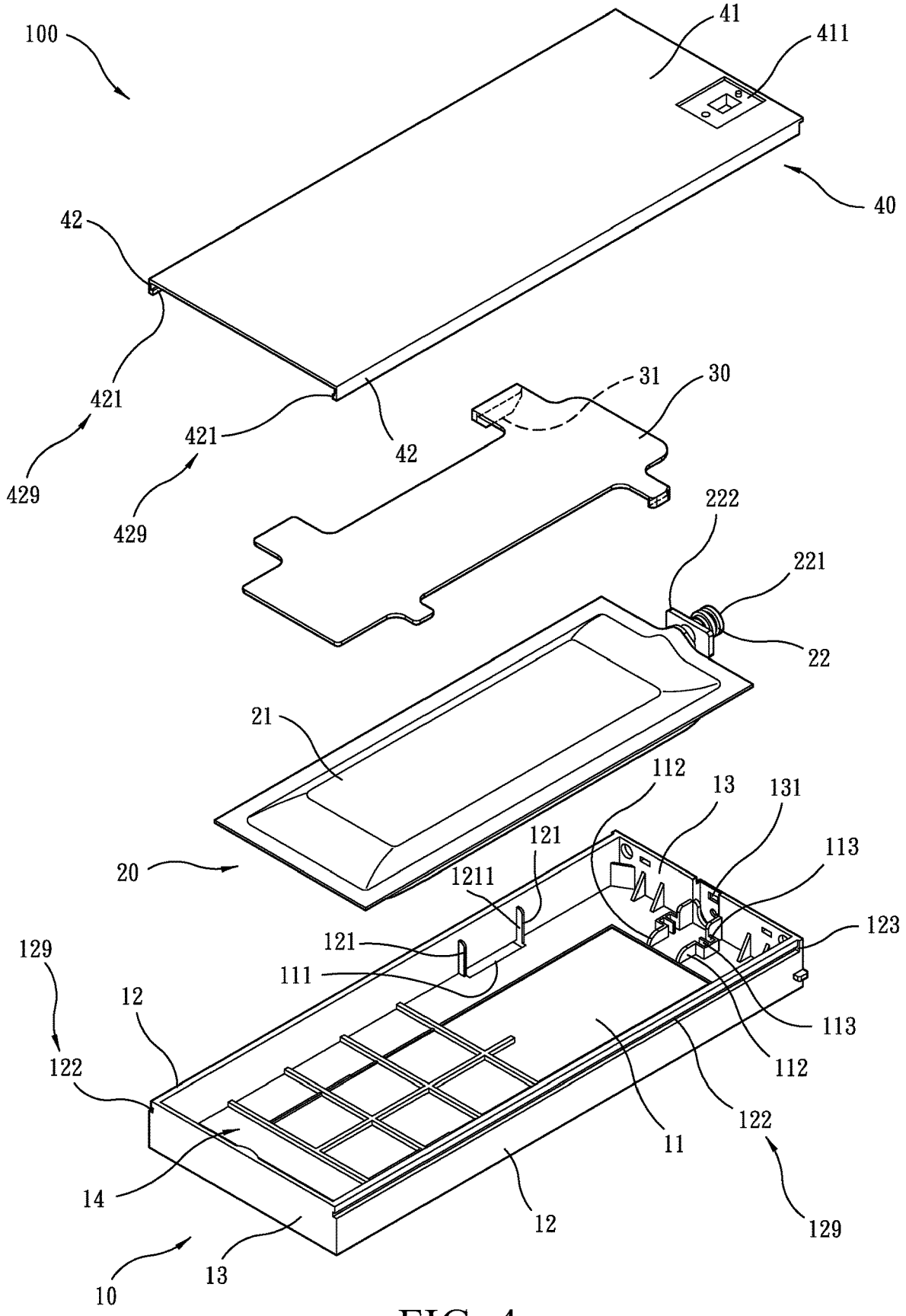
FIG. 4 is an exploded view of a first preferred embodiment provided in the present invention.
Figure 5:
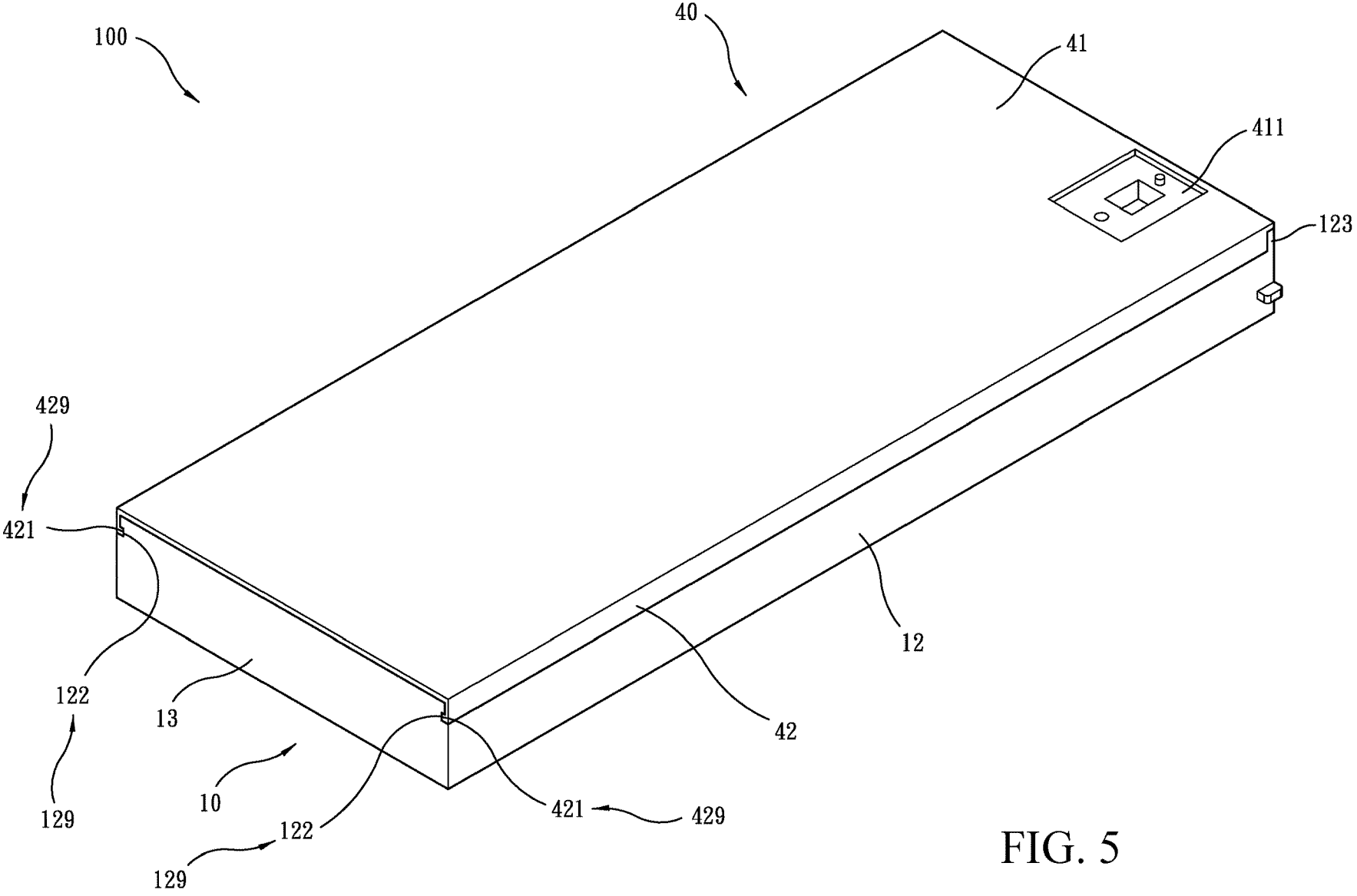
FIG. 5 is a perspective view showing illustrating the embodiment of FIG. 4 in an assembled form.
Figure 6:
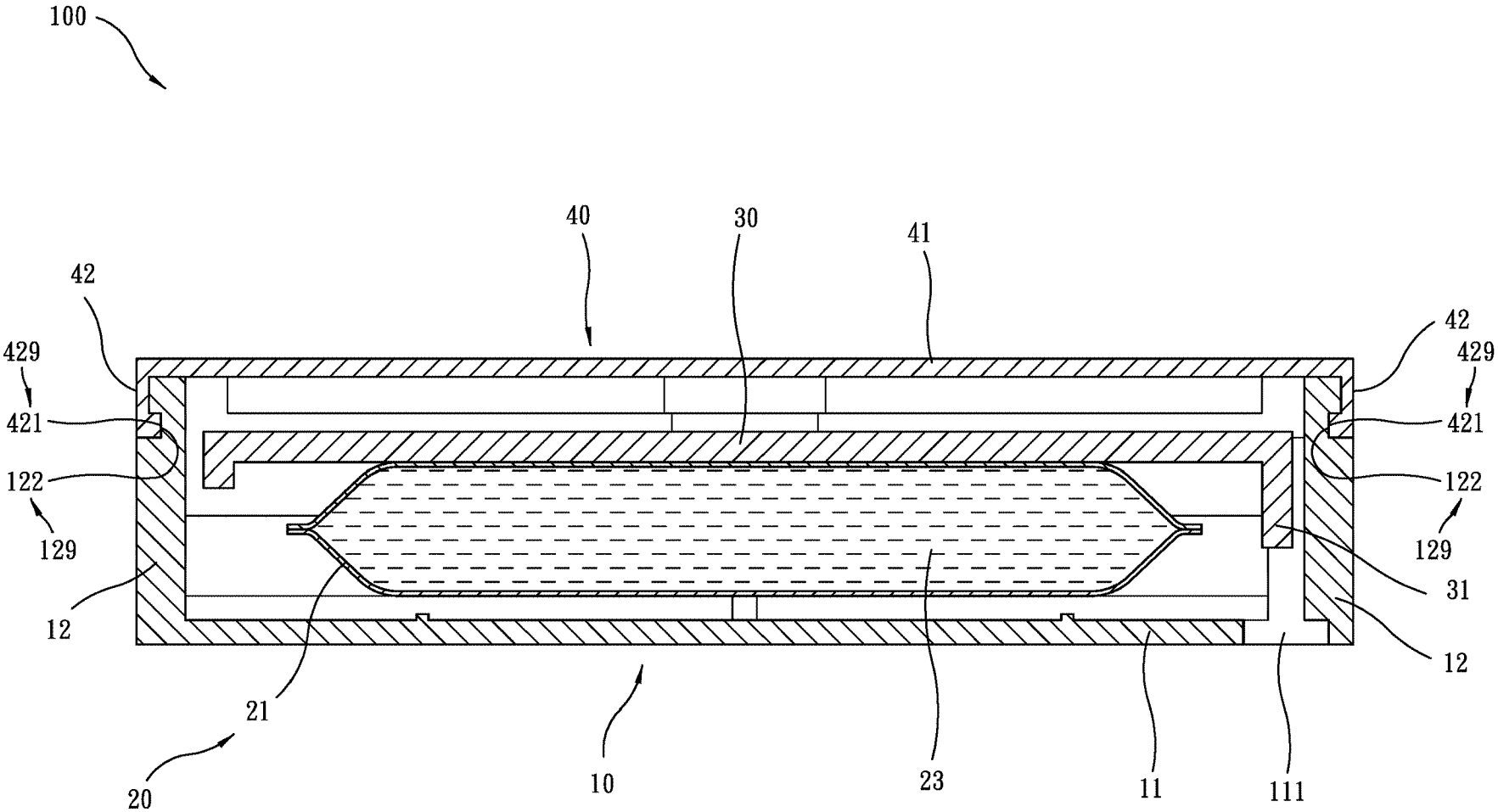
FIG. 6 is a cross-sectional view illustrating the embodiment of FIG. 4 in an assembled form.
Figure 7:
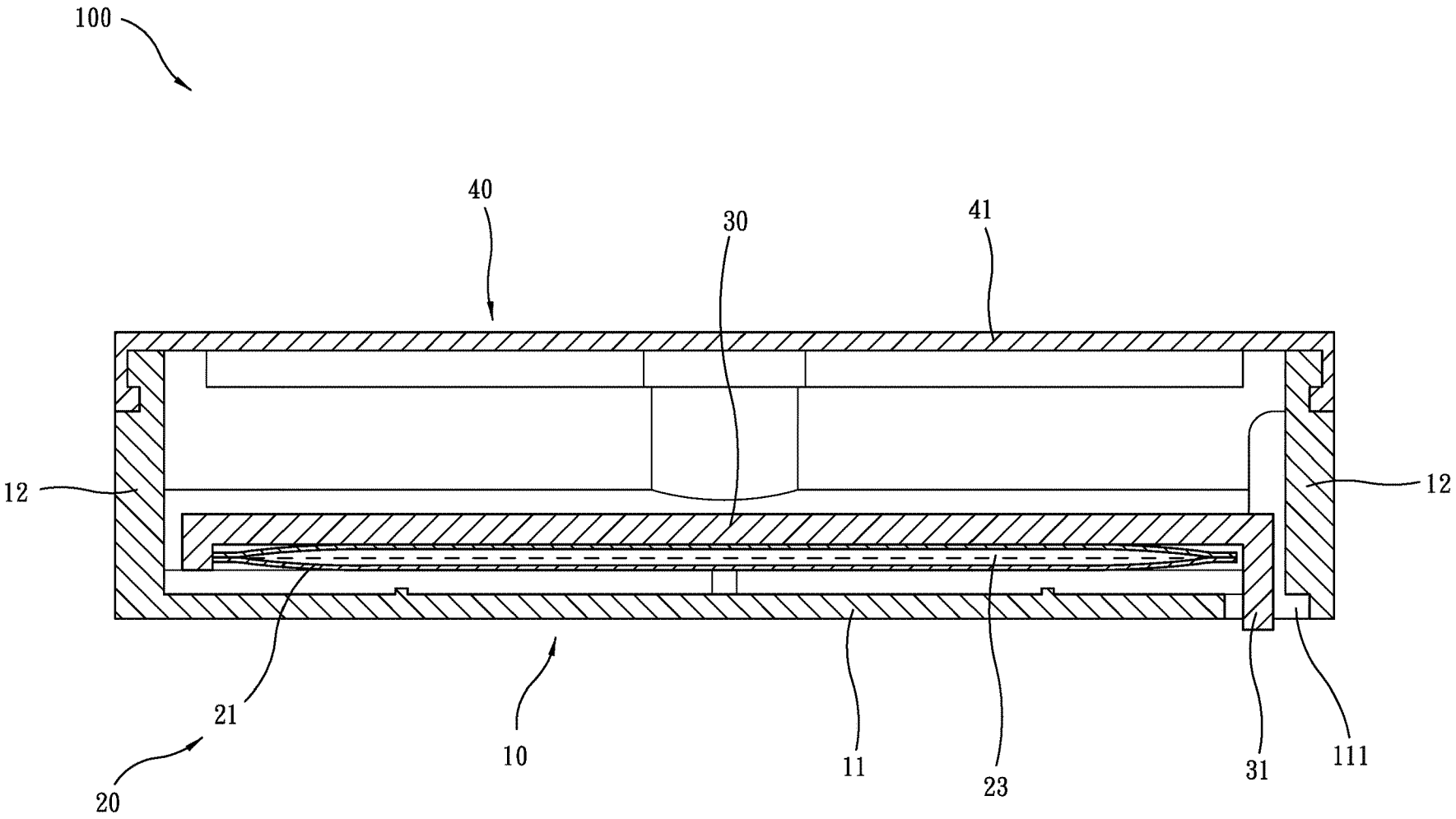
FIG. 7 is a cross-sectional view illustrating the embodiment of FIG. 4 in an assembled form.
Figure 8:
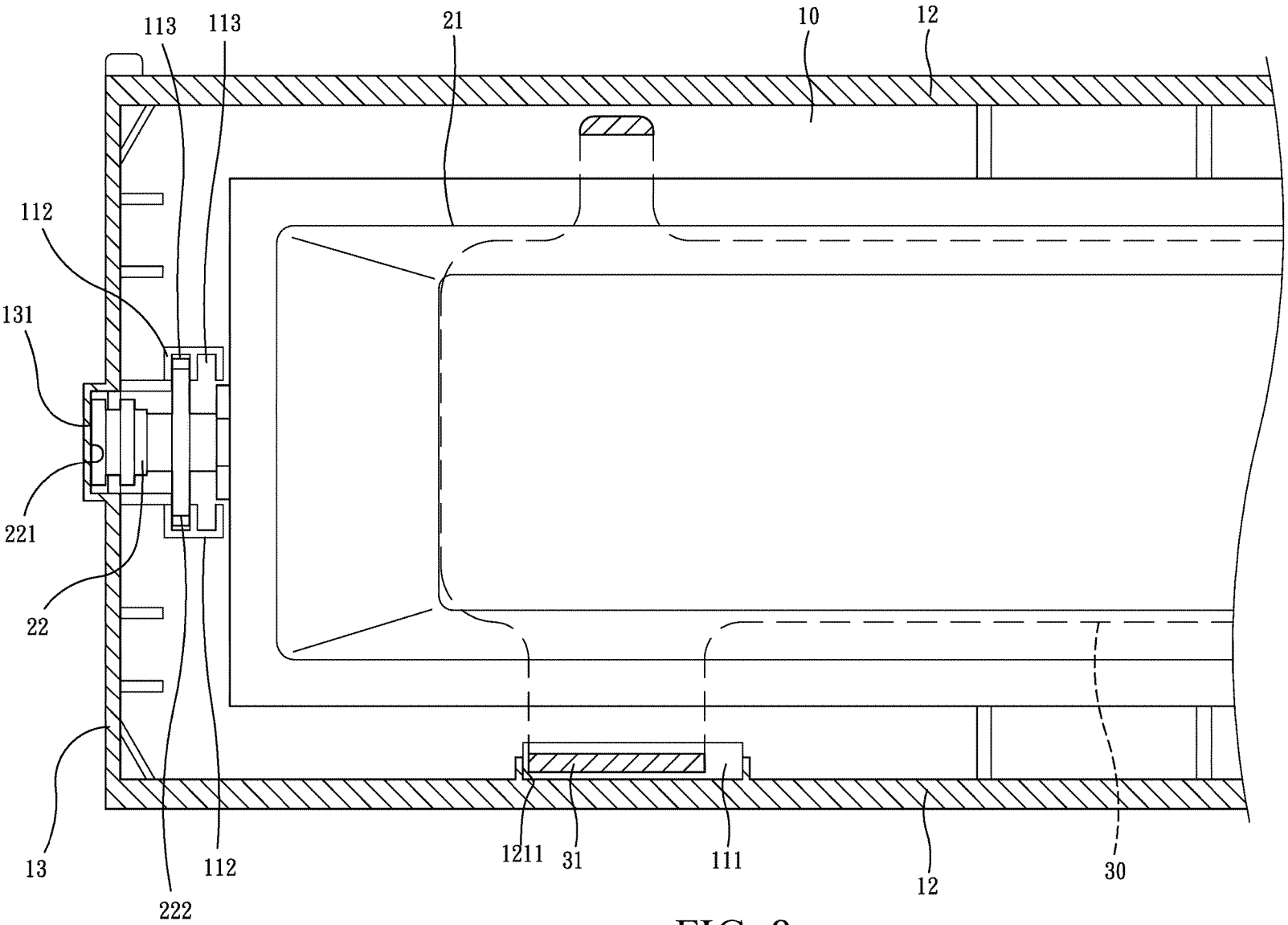
FIG. 8 is a cross-sectional view illustrating the embodiment of FIG. 4 in an assembled form.

Referring to FIGS. 4-8, an ink-sack-replaceable ink cartridge 100 according to a first preferred embodiment of the present invention is provided, generally comprising a cartridge body 10, an ink sack 20, a pressing board 30, and a cartridge cover 40.

Referring to FIGS. 4-8, the cartridge body 10 includes a bottom wall 11, two lateral walls 12 extending upward in a vertical direction from two opposite lateral sides of the bottom wall 11, and two end walls 13 extending upward in a vertical direction from two ends of the bottom wall 12. The end walls 13 are connected to the lateral walls 12, so that the bottom wall 11, the lateral walls 12, and the end walls 13 jointly define a receiving space 14 that has an open top. The bottom wall 11 is provided with a through hole 111 that is formed to penetrate therethrough at a location adjacent to one of the lateral walls 12. The bottom wall is provided, at a location adjacent to one of the end walls 13, with two constraint walls 112 that are located in the receiving space 14. Two the constraining troughs 113 are formed between the two constraint walls 112 define therebetween. Two positioning protrusions 121 that are arranged to extend in the vertical direction are formed on an inside surface of one of the lateral walls 12 that is adjacent to the through hole 111 and the two positioning protrusions 121 are respectively located at two ends of the through hole 111. The two positioning protrusions 121 each have a guide surface 1211. The guide surfaces 1211 are respectively connected to inside surfaces of the through hole 111 in a smooth transition manner. Each of the lateral walls 12 is provided with a cartridge-body slide coupling section 129. In the instant embodiment, each of the cartridge-body slide coupling sections 129 includes a slide groove 122 formed in an outside surface of the lateral wall 12 and extending longitudinally from one end to an opposite end, with a stop portion 123 provided at one end of the slide groove 122. One of the end walls 13 that is adjacent to the constraint walls 112 is formed with a thin wall zone 131 that corresponds, in position, to the constraint walls 112. The thin wall zone 131 has a wall thickness that is smaller than a wall thickness of a remaining portion of the end wall 13, and the thin wall zone 131 serves to receive an ink feeding tube of a printer (not shown) to puncture and insert therethrough.

Referring to FIGS. 4 and 6-8, the ink sack 20 is received in the receiving space 14 of the cartridge body 10. The ink sack 20 includes a sack body 21 and a connector 22 connected to an end of the sack body 21. The sack body 21 has an interior in which ink 23 is received and held. The connector 22 has a free end that is formed as a thin film 221 to be punctured through by the ink feeding tube. The connector 22 has an outer circumferential surface on which a limiting block 222 is formed. The limiting block 222 is fit into one of the constraining troughs 113 of the cartridge body 10.

Referring to FIGS. 4 and 6-8, the pressing board 30 is bonded to a top surface of the sack body 21 of the ink sack 20. The pressing board 30 is provided with a sensing section 31 projecting downward from one side thereof. The sensing section 31 is positionable between the guide surfaces 1211 of the two positioning protrusions 121 of the cartridge body 10 and is alignable with the through hole 111.

Referring to FIGS. 4-8, the cartridge cover 40 includes a top wall 41 and two side walls 42 extending downward from two opposite sides of the top wall 41. Each of the side walls 42 includes a cartridge-cover slide coupling section 429 provided thereon. In the instant embodiment, each of the cartridge-cover slide coupling sections 429 includes a rail 421 that is formed in an inside surface of each of the side walls 42 and longitudinally extends from one end to an opposite end thereof, so that the cartridge-cover slide coupling sections 429 of the cartridge cover 40 are respectively set in sliding coupling with the cartridge-body slide coupling sections 129 of the cartridge body 10 in a detachable manner, namely the slide rails 421 of the cartridge cover 40 are respectively set in slidable engagement with the slide grooves 122 of the cartridge body 10, and are blocked and retained in position by the stop portions 123, allowing the cartridge cover 40 to combine with or separate from the cartridge body 10 by means of the sliding connection for closing or opening the receiving space 14. The top wall 41 of the cartridge cover 40 has a top surface in which a recess is formed to define a chip zone 411 for receiving and retaining therein a chip.

The above provides a description to components of an ink-sack-replaceable ink cartridge 100 provided according to a preferred embodiment of the present invention, as well as the assembly thereof, and operation thereof will be described in the following.

Firstly, since the cartridge cover 40 and the cartridge body 10 are combined by means of sliding connection between the slide rails 421 and the slide grooves 122, separation between the cartridge cover 40 and the cartridge body 10 can be achieved through relative sliding therebetween by applying a force thereto for performance of replacement of the ink sack 20, thereby allowing repeated use of the cartridge body 10 and the cartridge cover 40 that are still workable so as to achieve reduction of waste of resources, and also allowing the user to only purchase the ink sack 20 so as to greatly reduce the amount of money that the user has to spend.

Further, since the sensing section 31 of the pressing board 30 is positioned and constrained between the two positioning protrusions 121 of the cartridge body 10, and thus being kept in a position in alignment with the through hole 111, when the pressing board 30 lowers due to the consumption of the ink 23 contained in the ink sack 20, the sensing section 31 may accurately penetrate into the through hole 111 to allow a correct data of the amount of ink to be detected by the printer for providing to and notifying the user, allowing the user to perform, in advance, purchasing before replacing of the ink sack 20, thereby reducing potential risk of delaying work and operation.

Further, since the two constraint walls 112 of the cartridge body 10 are formed with the two constraining troughs 113, they are adapted to various ways of arranging the limiting block 222 at different positions provided by different ink sack manufacturers, allowing the limiting block 222 of the ink sack 20 to be fit into either one of the constraining troughs 113, making the present invention more widely applicable and having improved market competition power.

Figure 9:
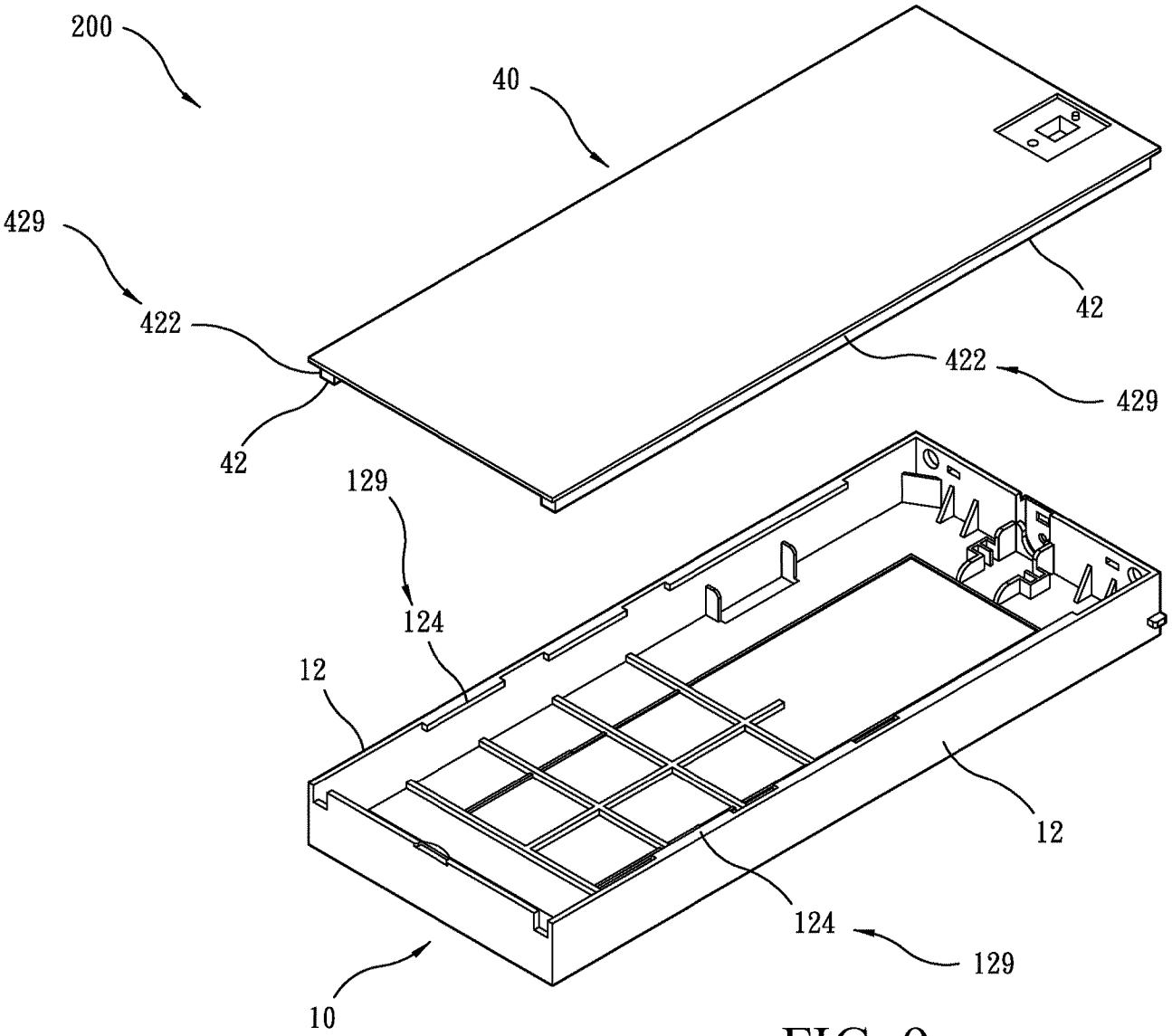
FIG. 9 is an exploded view of a second preferred embodiment provided in the present invention.
Figure 10:
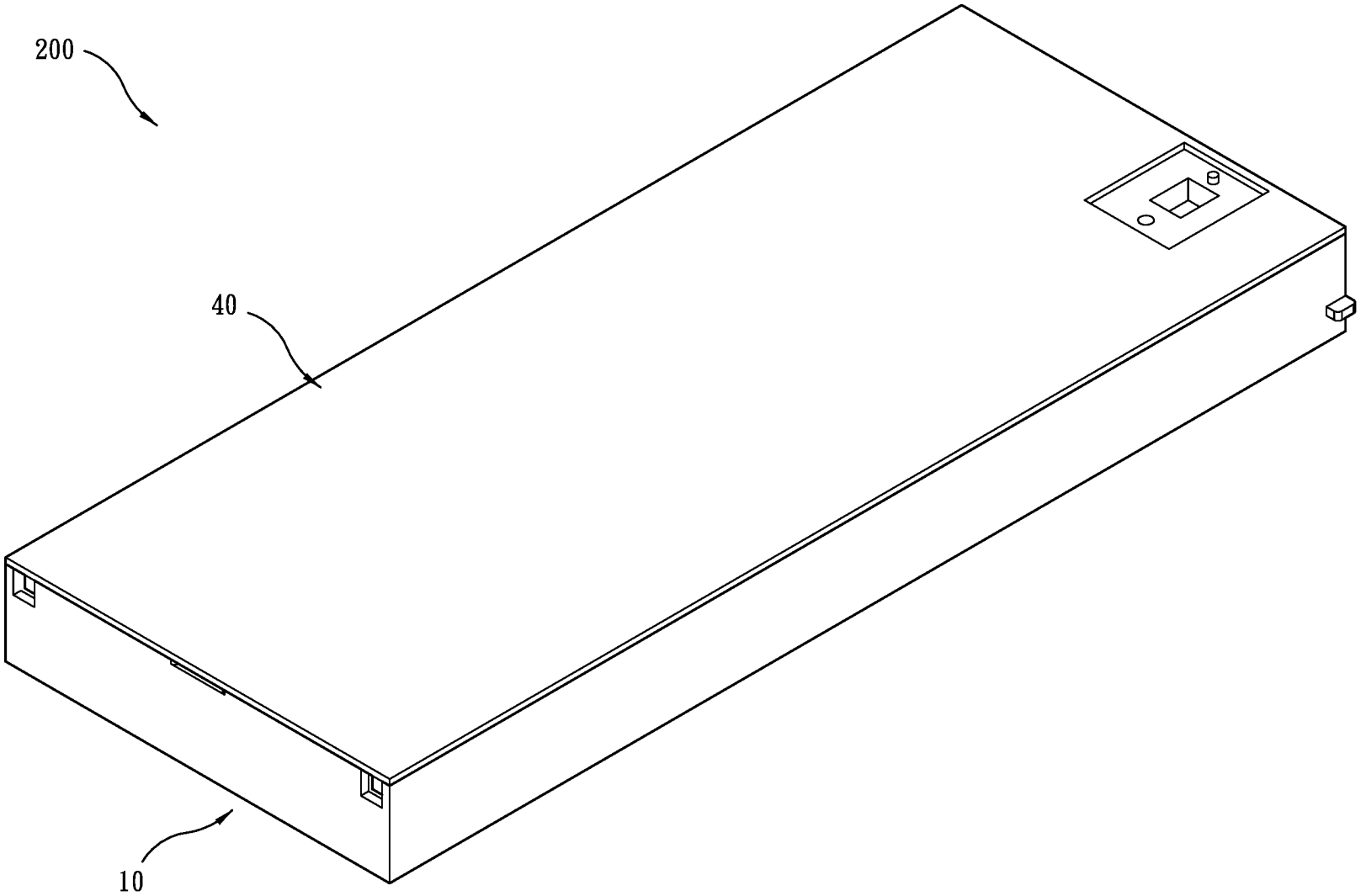
FIG. 10 is a perspective view illustrating the embodiment of FIG. 9 in an assembled form.
Figure 11:
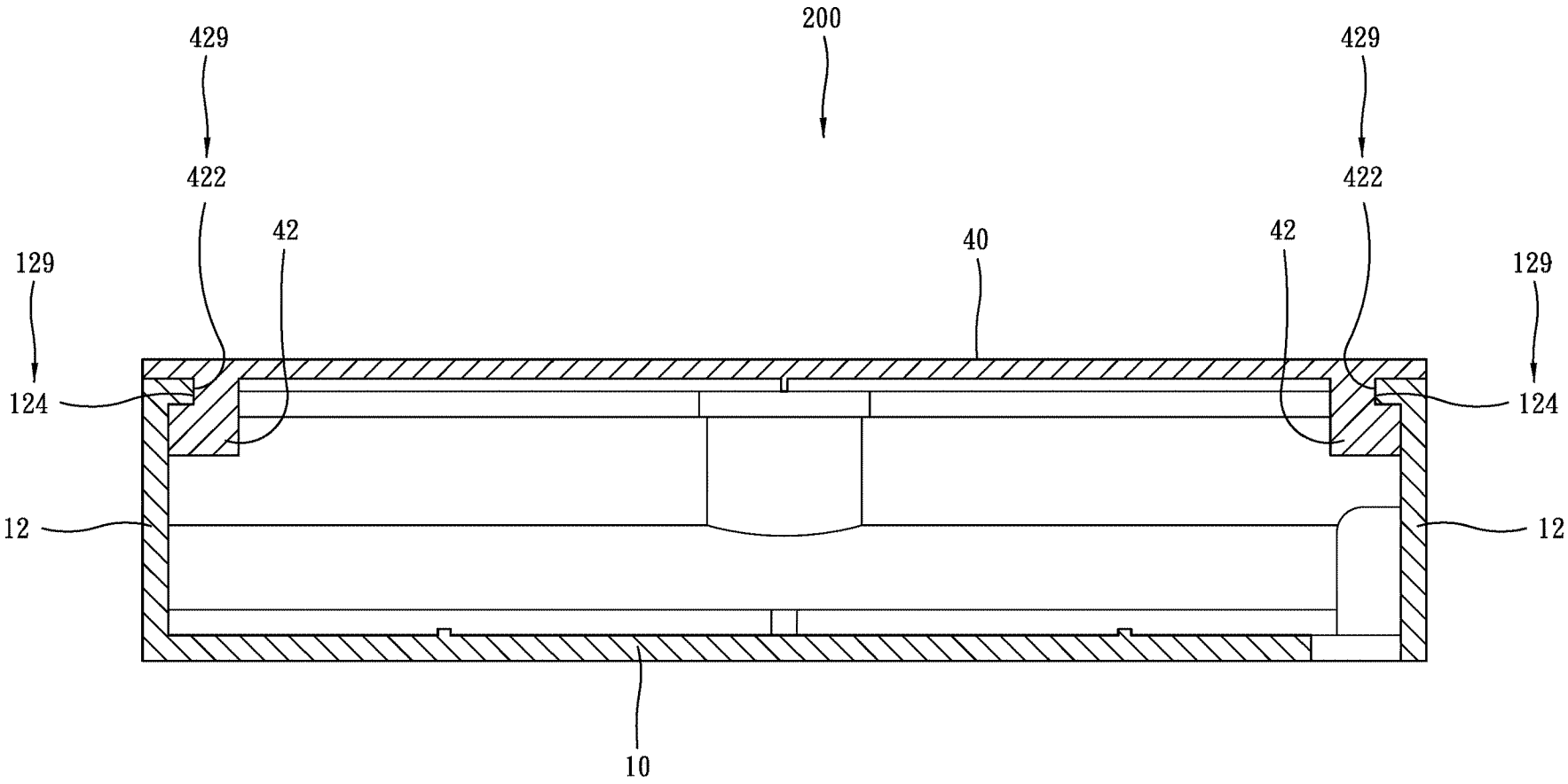
FIG. 11 is a cross-sectional view illustrating the embodiment of FIG. 9 in an assembled form.

Further, referring to FIGS. 9-11, an ink-sack-replaceable ink cartridge 200 according to a second preferred embodiment of the present invention is provided and comprises a cartridge body 10, an ink sack (not shown), a pressing board (not shown), and a cartridge cover 40 that are identical to those of the first preferred embodiment, with a major difference residing in the following:

In the instant embodiment, each of the lateral walls 12 of the cartridge body 10 is formed with a cartridge-body slide coupling section 129, and each of the cartridge-body slide coupling sections 129 includes a slide rail 124 formed in an inside surface of each of the lateral walls 12 and longitudinally extending from one end to an opposite end.

And, each of the side walls 42 of the cartridge cover 40 is formed with a cartridge-cover slide coupling section 429, and each of the cartridge-cover slide coupling sections 429 includes a slide groove 422 formed in an outside surface of each of the side walls 42 and longitudinally extending from one end to an opposite end, so that the cartridge-cover slide coupling sections 429 of the cartridge cover 40 are respectively set in slide coupling with the cartridge-body slide coupling sections 129 of the cartridge body 10 in a detachable manner, namely the slide rails 124 of the cartridge body 10 are respectively set in slidable engagement with the slide grooves 422 of the cartridge cover 40.

As such, although the structures of the cartridge-cover slide coupling sections 429 and the cartridge-body slide coupling sections 129 of the instant embodiment are different from those of the first embodiment, they both achieve the same effectiveness.

I claim:

1. An ink-sack-replaceable ink cartridge, comprising:

a cartridge body, the cartridge body comprising a bottom wall, two lateral walls extending upward in a vertical direction from two lateral sides of the bottom wall, and two end walls extending upward in the vertical direction from two ends of the bottom wall, the end walls and the lateral walls being connected so that the bottom wall, the lateral walls, and the end walls jointly surround and define a receiving space, the bottom wall comprising a through hole penetrating through top and bottom thereof, the through hole being formed through the bottom wall at a location adjacent to one of lateral walls, two positioning protrusions being formed on an inside surface of one of the lateral walls that is adjacent to the through hole and extending in a vertical direction, the two positioning protrusions being respectively located at two ends of the through hole, the two positioning protrusions each having a guide surface, the guide surfaces being smoothly connected to inside surfaces of the through hole; and a cartridge cover, the cartridge cover comprising a top wall and two side walls extending downward from two sides of the top wall, the cartridge cover being combinable with the cartridge body to close the receiving space.

2. The ink-sack-replaceable ink cartridge according to claim 1, wherein the cartridge body comprises a cartridge-body slide coupling section that comprise a slide groove, the slide groove being formed by longitudinally extending from an end of an outside surface of the lateral wall to an opposite end; and the cartridge cover comprises a cartridge-cover slide coupling section that comprises a slide rail, the slide rail being formed by longitudinally extending from an end of an inside surface of the side wall to an opposite end.

3. The ink-sack-replaceable ink cartridge according to claim 2, wherein a stop portion is formed at an end of each of the slide grooves.

4. The ink-sack-replaceable ink cartridge according to claim 1, wherein the cartridge body comprises a cartridge-body slide coupling section that comprises a slide rail, the slide rail being formed by longitudinally extending from an end of an inside surface of the lateral wall to an opposite end; and the cartridge cover comprises a cartridge-cover slide coupling section that comprises a slide groove, the slide groove being formed by longitudinally extending from an end of an outside surface of the side walls to an opposite end.

5. The ink-sack-replaceable ink cartridge according to claim 1, wherein a cartridge-body slide coupling section is formed on each of the lateral walls, and a cartridge-cover slide coupling section is formed on each of the side walls, each of the cartridge-cover slide coupling sections being slidably connectable with each of the cartridge-body slide coupling sections, so as to allow the cartridge cover to combine with and separate from the cartridge body through slidable connection for closing or opening the receiving space.

6. The ink-sack-replaceable ink cartridge according to claim 5, further comprising an ink sack and a pressing board, the ink sack being received in the receiving space of the cartridge body, the pressing board being bonded to the ink sack, a sensing section extending downward from one side of the pressing board, the sensing section being positionable between the two positioning protrusions of the cartridge body and alignable with the through hole.

7. The ink-sack-replaceable ink cartridge according to claim 1, wherein the bottom wall is provided, at a location adjacent to one of the end walls, with two constraint walls that are located in the receiving space, two the constraining troughs being arranged between the two constraint walls.

8. The ink-sack-replaceable ink cartridge according to claim 7, wherein a thin wall zone is formed on the end walls at a location adjacent to the constraint walls, the thin wall zone having a wall thickness that is smaller than a wall thickness of a remaining portion of the end walls.

9. The ink-sack-replaceable ink cartridge according to claim 7, further comprising an ink sack, the ink sack being received in the receiving space of the cartridge body, the ink sack comprising a sack body and a connector connected to an end of the sack body, the sack body having an interior for receiving and holding ink therein, the connector having a free end that is formed as a thin film, the connector having an outer circumferential surface on which a limiting block is formed, the limiting block being insertable into one of the constraining troughs of the cartridge body.

10. The ink-sack-replaceable ink cartridge according to claim 1, wherein the cartridge cover has a top wall that is recessed to form a chip zone.

11. An ink-sack-replaceable ink cartridge, comprising:

a cartridge body, the cartridge body comprising a bottom wall, two lateral walls extending upward in a vertical direction from two lateral sides of the bottom wall, and two end walls extending upward in a vertical direction from two ends of the bottom wall, the end walls and the lateral walls being connected so that the bottom wall, the lateral walls, and the end walls jointly surround and define a receiving space, the bottom wall comprising a through hole penetrating through top and bottom thereof, the bottom wall comprising two constraint walls located in the receiving space, two constraining troughs being arranged between the two constraint walls, each of the lateral walls being provided with a cartridge-body slide coupling section, two positioning protrusions being formed on an inside surface of one of the lateral walls and extending in a vertical direction, the two positioning protrusions being respectively located at two ends of the through hole, the two positioning protrusions each having a guide surface, the guide surfaces being smoothly connected with inside surfaces of the through hole;

an ink sack, the ink sack being received in the receiving space of the cartridge body, the ink sack comprising a sack body and a connector connected to an end of the sack body, the connector having an outer circumferential surface on which a limiting block is formed, the limiting block being insertable into one of the constraining troughs of the cartridge body;

a pressing board, the pressing board being bonded to the ink sack, a sensing section extending downward from one side of the pressing board, the sensing section being positionable between the two positioning protrusions of the cartridge body and alignable with the through hole; and a cartridge cover, the cartridge cover comprising a top wall and two side walls extending downward from two sides of the top wall, each of the side walls being provided with a cartridge-cover slide coupling section, each of the cartridge-cover slide coupling sections being slidably connectable with each of the cartridge-body slide coupling sections, so as to allow the cartridge cover to combine with and separate from the cartridge body through slidable connection for closing or opening the receiving space.

12. The ink-sack-replaceable ink cartridge according to claim 11, wherein the cartridge-body slide coupling sections of the cartridge body each comprise a slide groove, the slide groove being formed by longitudinally extending from an end of an outside surface of the lateral wall to an opposite end, a stop portion being formed at an end of each of the slide grooves; and the cartridge-cover slide coupling sections of the cartridge cover each comprise a slide rail, the slide rail being formed by longitudinally extending from an end of an inside surface of the side wall to an opposite end.

13. The ink-sack-replaceable ink cartridge according to claim 11, wherein the cartridge-body slide coupling sections of the cartridge body each comprise a slide rail, the slide rail being formed by longitudinally extending from an end of an inside surface of the lateral wall to an opposite end; and the cartridge-cover slide coupling sections of the cartridge cover each comprise a slide groove, the slide groove being formed by longitudinally extending from an end of an outside surface of the side walls to an opposite end.

* * * * *